US008913929B2

(12) United States Patent
Fujino et al.

(10) Patent No.: US 8,913,929 B2
(45) Date of Patent: Dec. 16, 2014

(54) DEVELOPING DEVICE, PROCESS CARTRIDGE AND IMAGE FORMING APPARATUS

(75) Inventors: Hirokazu Fujino, Mishima (JP); Nobuyoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 13/553,010

(22) Filed: Jul. 19, 2012

(65) Prior Publication Data

US 2013/0022376 A1 Jan. 24, 2013

(30) Foreign Application Priority Data

Jul. 20, 2011 (JP) ..... 2011-158941

(51) Int. Cl.
*G03G 15/08* (2006.01)

(52) U.S. Cl.
CPC .... *G03G 15/0808* (2013.01); *G03G 2215/0132* (2013.01)
USPC ..... 399/281; 399/119

(58) Field of Classification Search
USPC ..... 399/107, 110, 111, 119, 120, 252, 265, 399/279–281
See application file for complete search history.

(56) References Cited

U.S. PATENT DOCUMENTS 6,321,058 B1 * 11/2001 Miyasaka et al. ..... 399/281
7,313,351 B2 * 12/2007 Toyoda et al. ..... 399/279
7,865,118 B2 * 1/2011 Nakagawa et al. ..... 399/281

FOREIGN PATENT DOCUMENTS

JP 2003-173083 A 6/2003
JP 2006-268013 A 10/2006
JP 2010-211052 A 9/2010

* cited by examiner

*Primary Examiner* — Hoan Tran
(74) *Attorney, Agent, or Firm* — Fitzpatrick, Cello, Harper & Scinto

(57) ABSTRACT

A developing device for use with an image forming apparatus, includes a developing roller for carrying a developer and for forming a developer image on an image bearing member; a supplying roller for supplying the developer to the developing roller, wherein the supplying roller has a foam layer at its surface and forms a nip between itself and the developing roller; an accommodating portion, provided below the supplying roller, for accommodating the developer; and a feeding member for feeding the developer from the accommodating portion to a location above the nip by being rotated in a direction opposite to a rotational direction of the supplying roller. The supplying roller is rotated in a direction which is from a lower end of the nip to an upper end of the nip. The supplying roller is provided so that its top is higher than a top of the developing roller.

16 Claims, 9 Drawing Sheets

(a)

(b)

DEVELOPING DEVICE, PROCESS CARTRIDGE AND IMAGE FORMING APPARATUS

FIELD OF THE INVENTION AND RELATED ART

The present invention relates to a developing device, a process cartridge including the developing device, and an image forming apparatus including the developing device.

A conventional developing device, including a developing roller, a developer supplying roller and a developer accommodating chamber, for forming a toner image (developer image) by supplying a toner (developer) onto an electrostatic latent image formed on a photosensitive member has been known (Japanese Laid-Open Patent Application No. 2003-173083). A toner accommodating chamber as the developer accommodating chamber is provided below the developer supplying roller. The toner accommodating chamber is provided with a toner feeding member (developer feeding member) inside thereof. Further, by rotating the toner feeding member, the toner accommodated in the toner accommodating chamber is supplied to a toner supplying roller, as the developer supplying roller, provided above the toner accommodating chamber.

At this time, as shown in FIG. 11, it would be considered that a method of supplying the toner to a toner supplying roller 4 by feeding the toner to a portion which is a contact nip between the toner supplying roller 4 and a developing roller 3 and is the neighborhood of a downstream side of the toner supplying roller 4 with respect to a rotational direction of the toner supplying roller 4 is employed. The toner supplying roller 4 has an elastic foam layer at its outer periphery and when a nip N2 is opened in the downstream side of the rotational direction of the toner supplying roller 4, the toner is absorbed into the foam layer. Then, when the toner supplying roller 4 is compressed in an upstream side of the nip N2, the toner is discharged and supplied to the developing roller 3. Therefore, it can be said that feeding of the toner to the downstream side of the nip N2 which is a position where the toner supplying roller 4 absorbs the toner is a most efficient means as a toner supplying means.

However, it is difficult to accurately feed the toner to the absorbing position. Further, there was a case where the toner fed to the neighborhood of the downstream side of the above-described nip N2 was deposited on the surface of the toner supplying roller 4 and was fed in an arrow X1 direction in FIG. 11 and thus was returned again into a toner accommodating chamber E. In such a case, an amount of the toner supplied to the developing roller 3 is insufficient, so that an image defect such as a density non-uniformity is generated.

SUMMARY OF THE INVENTION

A principal object of the present invention is to provide a developing device, a process cartridge and an image forming apparatus which are capable of stably feeding a toner to a developer supplying roller.

According to an aspect of the present invention, there is provided a developing device for use with an image forming apparatus, comprising: a developing roller for carrying a developer and for forming a developer image on an image bearing member; a supplying roller for supplying the developer to the developing roller, wherein the supplying roller has a foam layer at its surface and forms a nip between itself and the developing roller; an accommodating portion, provided below the supplying roller, for accommodating the developer; and a feeding member for feeding the developer from the accommodating portion onto the nip by being rotated in a direction opposite to a rotational direction of the supplying roller, wherein the supplying roller is rotated in a direction which is from a lower end of the nip to an upper end of the nip, and wherein the supplying roller is provided so that its top is higher than a top of the developing roller.

According to the present invention, the developing device includes a developer retaining region enclosed by at least an inner wall of a frame located above the developing roller, the developing roller, the developer supplying roller and a horizontal surface connecting a topmost point of the developer supplying roller and the inner wall of the frame located above the developing roller. As a result, the developer is once fed to the developer retaining region and then the developer retained in the developer retaining region can be supplied to the developer supplying roller, so that it becomes possible to supply the developer stably and efficiently. Further, the topmost point of the developer supplying roller is provided at a position higher than a topmost point of the developing roller, so that it is possible to ensure a sufficient volume of the developer retaining region. As a result, it is possible to suppress an insufficient supply amount of the developer to the developing roller.

These and other objects, features and advantages of the present invention will become more apparent upon a consideration of the following description of the preferred embodiments of the present invention taken in conjunction with the accompanying drawings.

Figure 10:
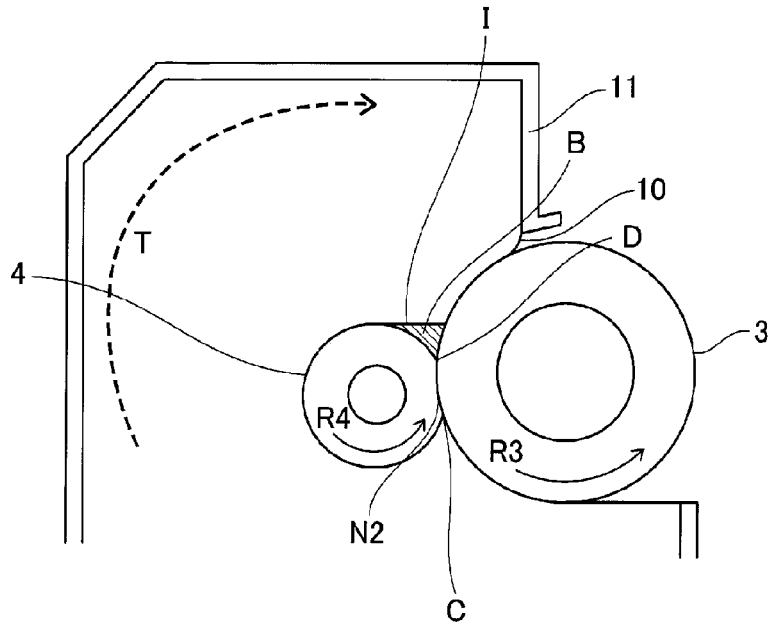
Figure 10:
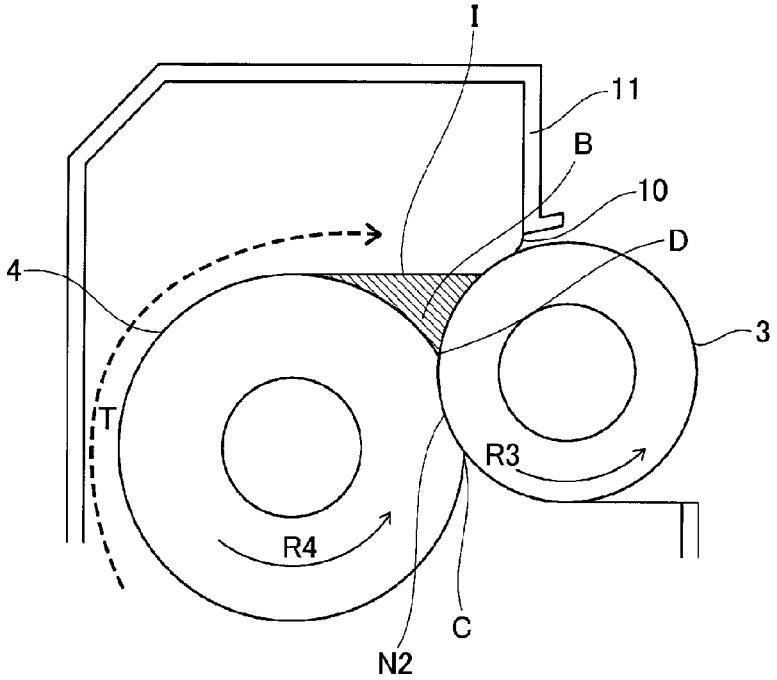

Parts (a) and (b) of FIG. 10 are enlarged schematic views each showing the neighborhood of a toner absorbing position of a toner supplying roller in Comparative Embodiment.

Figure 11:
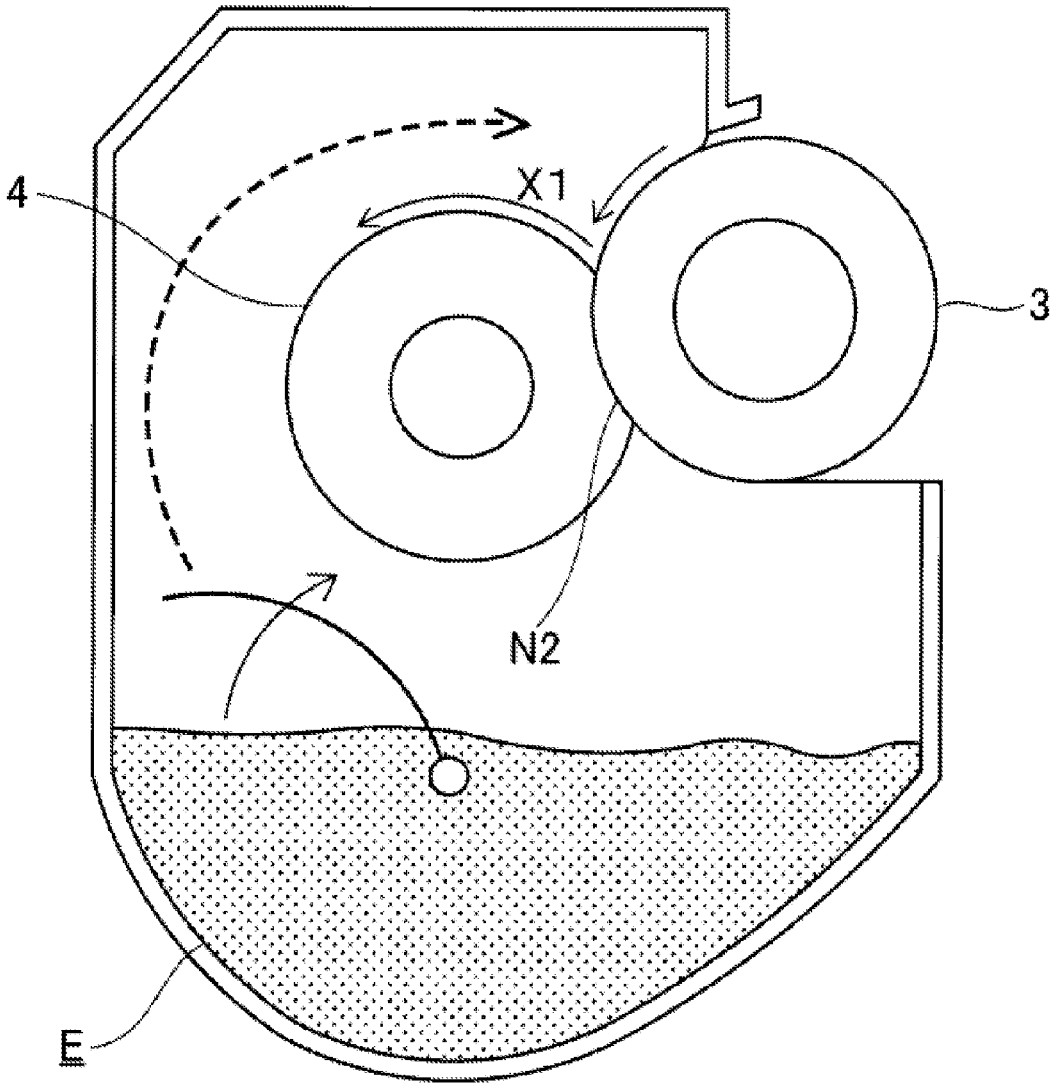
Fig. 11 PRIOR ART

FIG. 11 is a schematic sectional view of a hypothetical developing device on which the present invention is premised.

DESCRIPTION OF THE PREFERRED EMBODIMENTS

Embodiment 1

Figure 1:
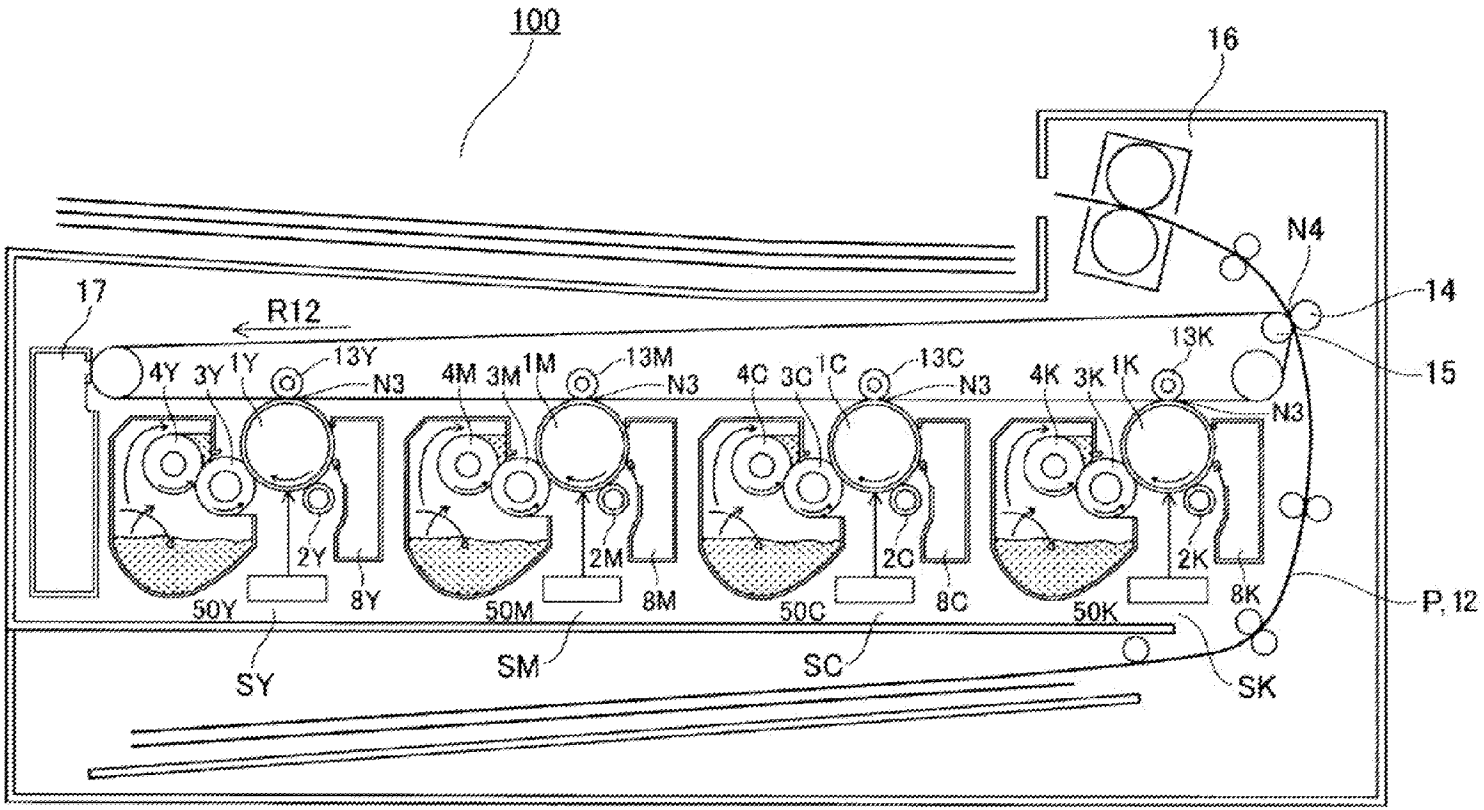
FIG. 1 is a schematic sectional view of an image forming apparatus according to Embodiment 1.

First, with reference to FIG. 1, a general structure of an image forming apparatus according to the present invention will be described. FIG. 1 is a schematic sectional view for illustrating the general structure of the image forming apparatus in this embodiment. As an image forming apparatus 100 in this embodiment, a full-color laser beam printer was used. Incidentally, the present invention is not limited to this embodiment but is also applicable to an image forming apparatus for effecting image formation of black (single color). The image forming apparatus 100 in this embodiment includes first, second, third and fourth image forming portions SY, SM, SC and SK for forming images of colors of yellow (Y), magenta (M), cyan (C) and black (K), respectively. Constitutions and operations of these image forming portions SY, SM, SC and SK are the substantially same except for difference in color. Therefore, in the case where a particular differentiation is not needed, suffixes Y, M, C and K added to reference numerals or symbols for representing elements or portions provided for associated colors are omitted and description of the elements or portions will be made.

Figure 2:
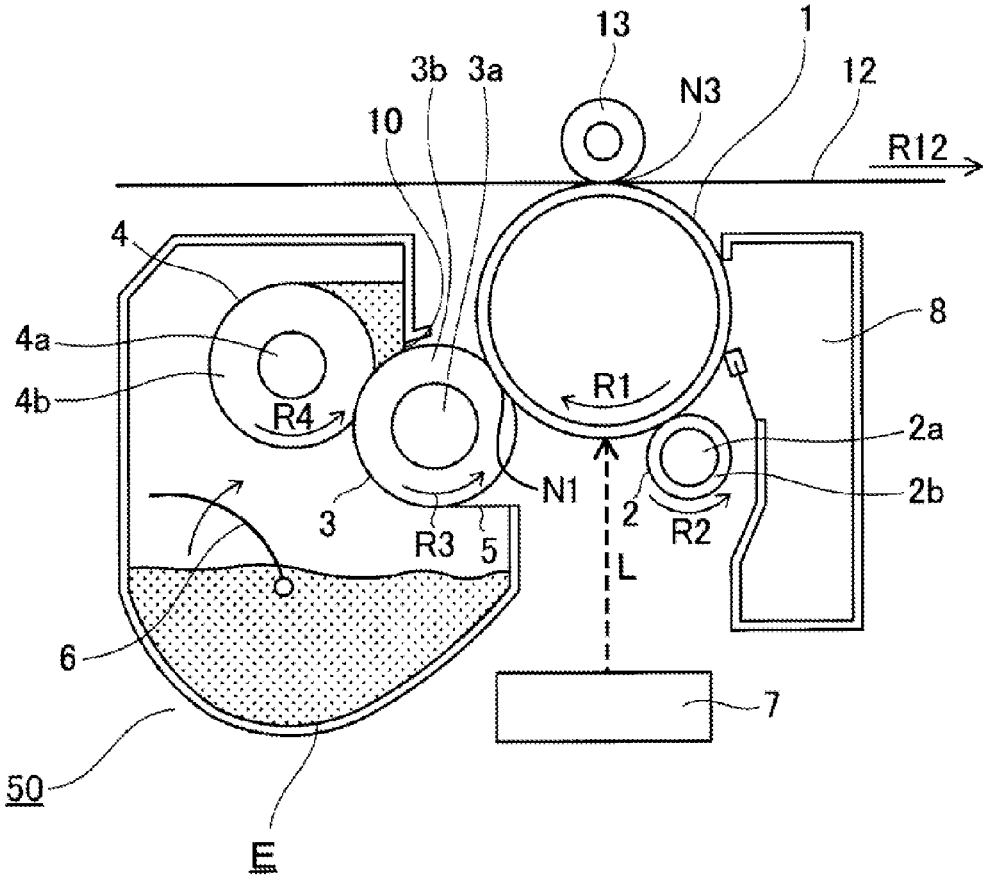
FIG. 2 is a schematic sectional view of an image forming portion of the image forming apparatus in Embodiment 1.

With reference to FIG. 2, image formation in the image forming apparatus of this embodiment will be described. FIG. 2 is a schematic sectional view for illustrating a general structure of each image forming portion provided in the image forming apparatus in this embodiment. Each image forming portion in the image forming apparatus 100 of this embodiment includes a developing device 1, a charging roller 2, a developing device 50 and a laser beam scanner device 7. When an image forming operation is started, the photosensitive drum 1 is electrically charged by the charging roller 2. Thereafter, the surface of the photosensitive drum 1 is irradiated with laser light L by the laser beam scanner device 7, so that an electrostatic latent image is formed on the surface of the photosensitive drum 1. The electrostatic latent image is visualized by supplying a toner as a developer onto the photosensitive drum 1 by the developing device 50, so that a toner image is formed. The toner image is primary-transferred onto an intermediary transfer belt 12 as an intermediary transfer member and then is secondary-transferred from the intermediary transfer belt 12 onto a recording material P such as paper.

Here, details of the primary transfer and the secondary transfer will be described. As shown in FIG. 1, the intermediary transfer belt 12 is stretched and extended around a plurality of supplying members. Further, the intermediary transfer belt 12 is contacted to all of the photosensitive drums 1 and is moved in an arrow R12 in FIG. 2. In an inner peripheral surface side of the intermediary transfer belt 12, four primary transfer rollers 13 as a primary transfer means are juxtaposed so as to oppose the respective photosensitive drums 1. Each primary transfer roller 13 urges the intermediary transfer belt 12 toward the associated photosensitive drum 1 to form a nip N3 at a primary transfer portion where the intermediary transfer belt 12 and the photosensitive drum 1 contact each other. Then, to the primary transfer roller 13, by a primary transfer bias voltage applying device (not shown), a primary transfer bias (voltage) is applied. As a result, the toner image formed on the photosensitive drum 1 is transferred onto the intermediary transfer belt 12. Incidentally, a transfer residual toner on the photosensitive drum 1 after the primary transfer of the toner image is ended is removed by a cleaning device 8 provided with a blade-like cleaning means. Further, after the secondary transfer of the toner image is ended, the transfer residual toner on the intermediary transfer belt 12 is removed by an intermediary transfer belt cleaning device 17 provided with a blade-like cleaning means, so that the image forming apparatus 100 prepares for a subsequent image forming operation.

Further, as shown in FIG. 1, in an outer peripheral surface side of the intermediary transfer belt 12, a secondary transfer roller 14 as a secondary transfer means is disposed at a position where it opposes a secondary transfer opposite roller 15. The secondary transfer roller 14 is press-contacted to the intermediary transfer belt 12 toward the secondary transfer opposite roller 15 to form a nip N4 at a secondary transfer portion where the intermediary transfer belt 12 and the secondary transfer roller 14 contact each other. Then, to the secondary transfer roller 14, by a secondary transfer bias voltage applying device (not shown), a secondary transfer bias (voltage) is applied. As a result, the toner image on the intermediary transfer belt 12 is transferred onto the recording material P.

An unfixed toner image which is secondary-transferred and carried on the recording material P is then subjected to heating by a heating roller (fixing means) and pressure application by a pressing means which are provided in a fixing device, thus being fixed as a permanent image on the recording material P.

Incidentally, in this embodiment, the photosensitive drum 1, the developing device 50, the cleaning device 8 and the charging roller 2 are integrally constituted as a process cartridge, which is detachably mountable to an image forming apparatus main assembly.

Further, details of the respective portions of the image forming apparatus in this embodiment will be described. In the following, with respect to the developing device 50 and the process cartridge, in the case where a direction such as an up-down direction is described, the direction refers to the direction in a state in which they are mounted in the image forming apparatus main assembly. The photosensitive drum 1 is rotationally driven in an arrow R1 direction shown in FIG. 2 at a peripheral speed of 135 mm/sec as a process speed. The photosensitive drum 1 is constituted by applying a layer of an organic photoconductor (OPC) onto an outer peripheral surface of an aluminum cylinder of 24 mm in diameter. Incidentally, the photosensitive drum 1 is not limited to an organic photosensitive member but the aluminum cylinder may also be coated with a layer of a-Si (amorphous silicon), CdS, Se, or the like. The charging roller 2 is contacted to the photosensitive drum 1, thus being rotated in an arrow R2 direction in FIG. 2 by rotation of the photosensitive drum 1. To the charging roller 2, a charging bias voltage applying device (not shown) is connected. In this embodiment, as a charging bias (voltage), a DC bias (voltage) is used but a bias (voltage) in the form of a DC component biased with an AC component may also be used. Further, the charging roller 2 in this embodiment was 10 mm in diameter and had a multi-layer structure formed by providing, on a peripheral surface of a core metal 2*a* which is a cylindrical member of stainless steel, an elastic layer 2*b* consisting of a base layer of urethane rubber and a surface layer of fluorine-containing resin. Incidentally, the charging roller 2 is not limited thereto but as the core metal 2*a*, metal such as aluminum or aluminum alloy may also be used. Further, as the surface layer of the elastic layer 2*b*, a layer of ether urethane, nylon or the like may also be used. The laser beam scanner device 7 in this embodiment is provided with a semiconductor laser (not shown). The semiconductor laser emits the laser light L depending on an image signal corresponding to an inputted signal. The laser light L is reflected by a polygon mirror (not shown) and passes through an imaging lens (not shown), so that the surface of the photosensitive drum 1 is irradiated with the laser light L.

The developing device 50 includes a developing roller 3, a toner supplying roller 4 as a developer supplying roller, a developing blade 5, a toner accommodating chamber E as a developer accommodating chamber provided below the toner supplying roller 4, and a toner feeding member 6 as a developer feeding member. Incidentally, in this embodiment, a contact development type in which the developing roller 3 is contacted to the photosensitive drum 1 to form a nip N1 and development is effected in a state in which the toner is contacted to the photosensitive drum 1 is employed. The developing device 50 includes a frame 11 having an inner hollow space, and at a lower portion of the inner hollow space, the toner accommodating chamber E is provided, and at an upper portion of the inner hollow space, the toner supplying roller 4 and the developing roller 3 are provided. Further, the toner supplying roller 4 and the developing roller 3 are rotatably supplied by the frame 11. Further, the developing roller 3 is provided at an opening provided at the frame 11 and its surface portion exposed from the opening is contacted to the photosensitive drum 1. Further, at the inner portion of the frame 11, the toner supplying roller 4 is contacted to the developing roller 3.

Further, details of the developing device 50 in this embodiment will be described. The developing roller 3 is rotated while carrying the toner to supply the toner to the photosensitive drum 1, so that the electrostatic latent image is visualized. The developing roller 3 is rotated in an arrow R3 direction in FIG. 2 (the counterclockwise direction in the figure) at a peripheral speed of 160 mm/sec, and is contacted to the photosensitive drum 1 with a predetermined contact pressure. Further, the developing roller 3 includes an elastic layer 3*b* on a peripheral surface of a core metal 3*a* of stainless steel. The core metal 3*a* includes a metal cylinder of aluminum or aluminum alloy. The elastic layer 3*b* has a multi-layer structure consisting of a base layer of urethane rubber and a surface layer of urethane rubber in which carbon black is mixed. The base layer may also be formed with a rubber material such as NBR, EPDM, silicone rubber or urethane rubber. Further, the surface layer may also be constituted by ether urethane or nylon. In this embodiment, the developing roller 3 was 16 mm in diameter, and a longitudinal layer of the elastic layer 3*b* was 220 mm. Further, to the developing roller 3, by a developing bias voltage applying device (not shown) as a developing bias voltage applying means, a DC developing bias (voltage) of −300 V is applied. The developing blade 5 was formed with a 0.1 mm-thick leaf spring-like thin elastic regulating member of SUS (stainless steel). Incidentally, the developing blade 5 is not limited thereto but may also use a thin metal plate of phosphor bronze, aluminum or the like. Further, on the surface of the developing blade 5, as an insulating layer, a thin layer of polyamide elastomer, urethane rubber, urethane resin or the like may also be formed by coating. Further, to the developing blade 5, a blade bias (voltage) is applied from a regulating member bias voltage applying means. The toner supplying roller 4 is disposed so that a penetration depth (maximum compression amount of a foam layer with respect to a radial direction) with respect to the developing roller 3 is 1.5 mm, thus supplying the toner to the developing roller 3. In this embodiment, the toner supplying roller 4 is an elastic roller formed with a foam member and is 220 mm in longitudinal width, and is rotated in an arrow R4 direction in FIG. 2 (the counterclockwise direction in the figure) at a peripheral speed of 160 mm/sec. Therefore, in the nip N2 between the developing roller 3 and the toner supplying roller 4, the surface of the developing roller 3 is moved downward, and the toner supplying roller 4 is moved upward. That is, the toner supplying roller 4 is rotated in a direction which is from a lower end to upper end of the nip N2. The developing blade 5 is provided so as to urge the developing roller 3.

Next, the toner supplying roller 4 provided in the developing device 50 in this embodiment will be described further in detail. The toner supplying roller 4 in this embodiment includes an electroconductive supplying member 4*a* and a foam layer supplied by the electroconductive supplying member 4*a*. In the image forming apparatus in this embodiment, the electroconductive supplying member 4*a* is a core metal electrode of 5 mm in outer diameter. The foam layer is an urethane layer 4*b* constituted by an open-cell foam (interconnected cell) member in which air bubbles are connected to each other. Thus, by constituting the surface urethane layer as the open-cell foam, the toner can enter the inside of the toner supplying roller 4 in a large amount. Further, the electric resistance of the toner supplying roller 4 is $1\times10^9$ ohm. To the toner supplying roller 4, the DC voltage of −50 V is applied, and at that time, a resistance of 10 kΩ is provided on the ground side and the voltage at both ends is measured to calculate the current, so that the electric resistance of the toner supplying roller 4 can be calculated.

Next, a surface cell of the toner supplying roller 4 in this embodiment will be described. In this embodiment, a surface cell diameter of the supplying roller 3 was 50 μm to 100 μm, and a porosity was 0.6. Here, the "cell diameter" means an average diameter of the foam cell at an arbitrary cross section. First, a maximum area of the foam cell is measured from an enlarged image at the arbitrary cross section and is converted into an equivalent perfect circle diameter to obtain the maximum cell diameter. Then, a portion of the foam cell which is ½ or less of the maximum cell diameter is deleted as noise and thereafter individual cell diameters are obtained by converting individual cell areas of a remaining portion of the foam cell, so that the above-described average diameter is obtained as an average of the individual cell diameters. This average is used as the average diameter of the foam cell. Further, the porosity refers to a foam cell proportion at the arbitrary cross section. First, an area of each foam cell is measured from the enlarged image at arbitrary cross section to obtain a total area of the foam cells. Then, a proportion of the total area of the foam cells to the arbitrary cross section is obtained, and a value thereof is used as the porosity.

In this embodiment, the toner supplying roller 4 had a surface air flow amount of 1.8 liters/minute. Here, details of the "surface air flow amount" of the toner supplying roller 4 in this embodiment will be described. In this embodiment, the air flow amount is determined so that toner absorption into and toner discharge from the toner supplying roller 4 are smoothly effected to provide an equivalent state between the inside and outside of the toner supplying roller 4. The discharge and absorption of the toner which is changed into particulates by being mixed with the air are effected through the surface of the surface layer of the toner supplying roller 4 and therefore it is important that the air flow amount through the surface of the surface layer is directly determined.

Figure 3:
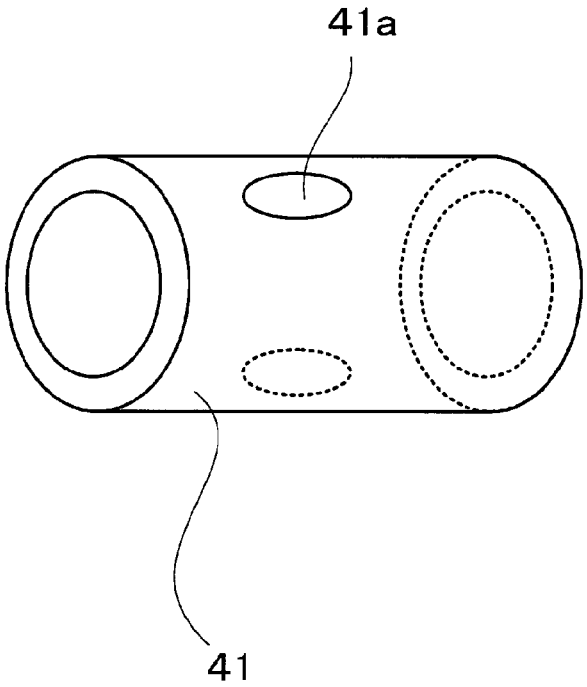
FIG. 3 is a schematic view showing a measuring jig used for measuring a surface air flow amount of a toner supplying roller.
Figure 4:
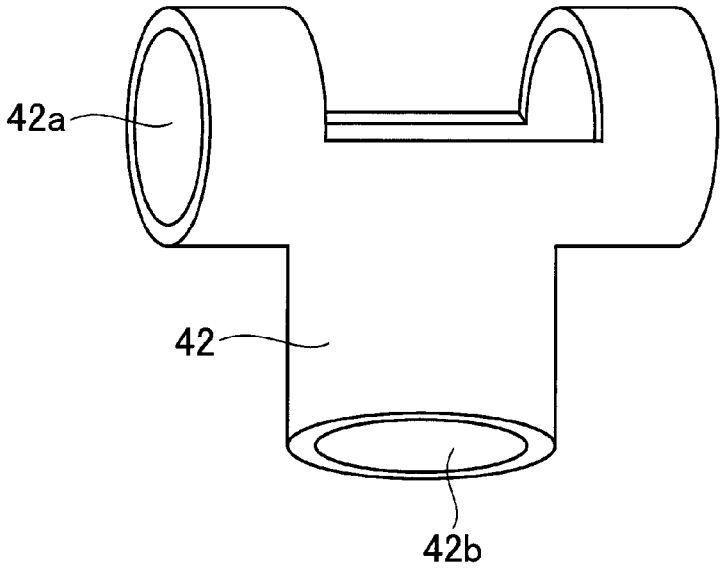
FIG. 4 is a schematic view showing an air flow holder used for measuring the surface air flow amount of the toner supplying roller.
Figure 5:
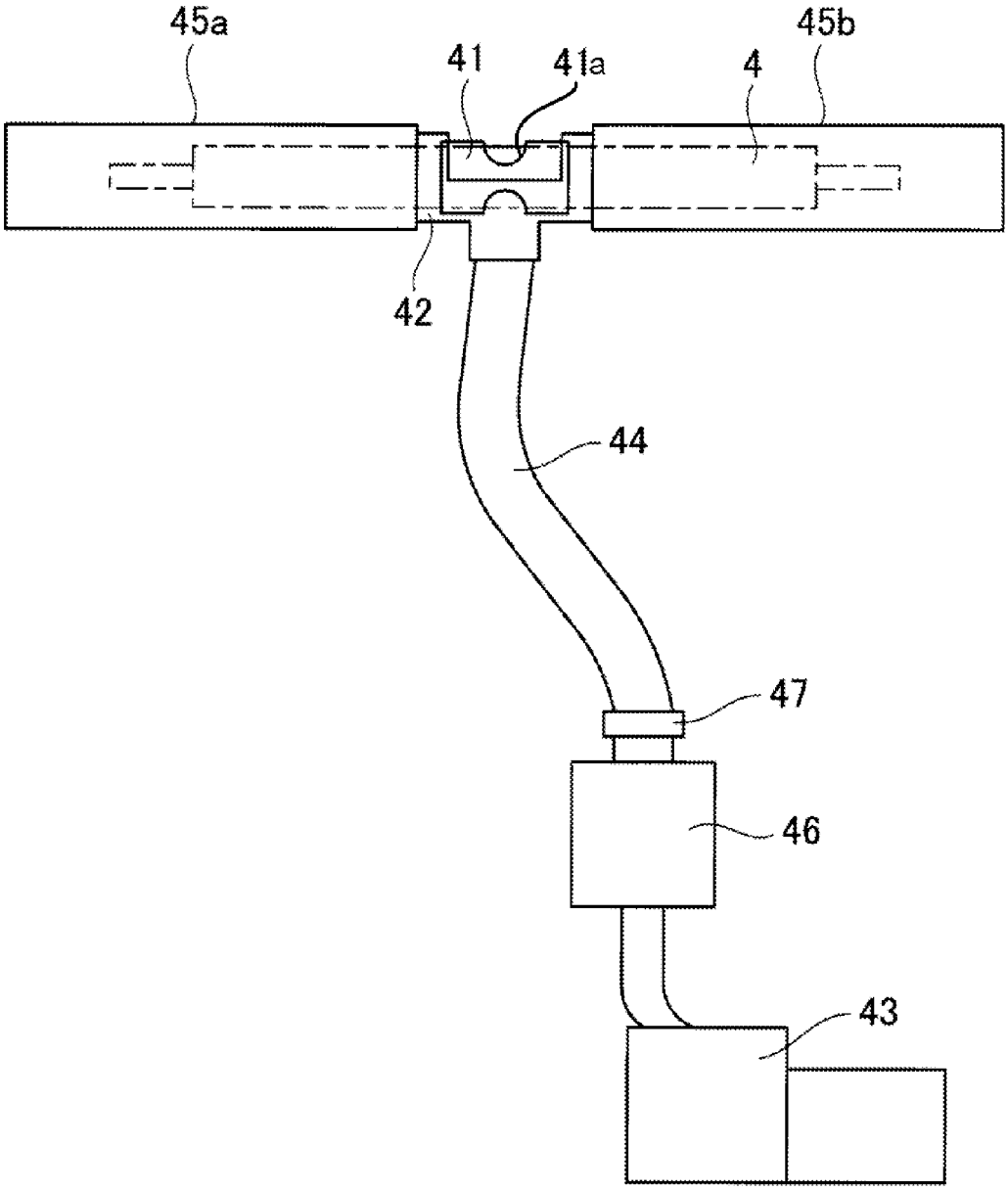
FIG. 5 is a schematic view for illustrating measurement of the surface air flow amount of the toner supplying roller.

With reference to FIGS. 3 to 5, members used for measuring the surface air flow amount of the toner supplying roller 4 will be described. FIG. 3 is a schematic view showing a measuring jig 41 used for the measurement of the surface air flow amount of the toner supplying roller 4. FIG. 4 is a schematic view showing a ventilation (air flow) holder 42 used for the measurement of the surface air flow amount of the toner supplying roller 4. FIG. 5 is a schematic view for illustrating the measuring method of the surface air flow amount of the toner supplying roller 4. First, the toner supplying roller 4 in this embodiment is inserted into the measuring jig 41 as shown in FIG. 3. The measuring jig 41 is prepared by providing a through hole 41*a* of 10 mm in diameter which penetrates through a side surface of a hollow cylindrical member so that a center axis of the through hole 41*a* and an axis of the cylinder of the hollow cylindrical member are perpendicular to each other. An inner diameter of the measuring jig 41 used is 1 mm smaller than the outer diameter of the toner supplying roller 4 to be measured. This is done in order to eliminate the gap between the inner surface of the measuring jig 41 and the outer surface of the toner supplying roller 4 to be measured. The toner supplying roller 4 in this embodiment has the outer diameter of 16 mm and therefore the inner diameter of the measuring jig 41 is 15 mm. The measuring jig 41 in which the toner supplying roller 4 has been inserted is attached to the ventilation holder 42 as shown in FIG. 4. The ventilation holder 42 has a T-like shape such that a hollow cylindrical member 42*a* is connected at its side surface to a connecting pipe 42*b* to which a ventilation pipe 44 communicating with a pressure reducing pump 43 is to be attached, and has such a shape that a portion opposite from the connected portion of the connecting pipe 42*b* has been considerably cut away. Further, the inner diameter of the connecting pipe 42*b* is set so as to be larger than the diameter of the through hole 41*a* of the measuring jig 41. In this embodiment, the inner diameter of the connecting pipe 42*b* was set at 12 mm. The inner diameter of the hollow cylindrical member 42*a* of the ventilation holder 42 has the substantially same dimension as the outer diameter of the measuring jig 41, so that the measuring jig 41 can be inserted into the hollow cylindrical member 42*a* of the ventilation holder 42. Further, as shown in FIG. 5, one end of the through hole 41*a* of the measuring jig 41 is entirely exposed to the cut-away portion of the hollow cylindrical member 42*a*, and the other end of the through hole 41*a* of the measuring jig 41 is provided such that its center is substantially aligned with the inner diameter portion of the connecting pipe 42*b*.

On left and right sides of the hollow cylindrical member 42*a* of the ventilation holder 42, acrylic pipes 45*a* and 45*b* each of which is connected to the hollow cylindrical member 42*a* at one end and is stopped up at the other end are provided. The toner supplying roller 4 extending from each of left and right ends of the measuring jig 41 is accommodated in the acrylic pipe 45*a* and 45*b*.

At intermediate portions of the ventilation pipe 44, a flow meter 46 ("KZ Type Air Permeability Tester", mfd. by Daiei Kagaku Seiki Mfg. Co., Ltd.) and a differential pressure control valve 47 are provided. Connecting portions of the measuring jig 41, the ventilation holder 42, the ventilation pipe 44 and the acrylic pipes 45*a* and 45*b* are sealed with a tape or grease so that when the inside air of the ventilation pipe 44 is evacuated by a pressure reducing pump 43, the ambient air can be prevented from entering the inside of the ventilation pipe 44 through a portion except the through hole 41*a* of the exposed measuring jig 41.

Next, the measuring method of the surface air flow amount will be described. First, in a state in which the toner supplying roller 4 is not disposed, the pressure reducing pump 43 is actuated and the pressure is adjusted by the differential pressure control valve 47 so that a measured value of the flow meter 46 is stable and is 10.8 liters/min. Thereafter, the toner supplying roller 4 which is an object to be measured is disposed and is carefully sealed as described above, and then the measured value of the flowmeter 46 under the same evacuation condition as that described above is taken as the surface air flow amount. The surface air flow amount is taken as a value at the time when the measured value of the flowmeter 46 is sufficiently stabilized. The air flow which will pass through the toner supplying roller 4 enters the urethane foam layer 4*b*, located at the through hole 41*a* when the measuring jig 41 is exposed, from the surface of the urethane foam layer 4*b* and passes through the inside of the urethane foam layer 4*b* and then comes outs of the surface of the urethane foam layer 4*b* located at the other-side through hole 41*a* of the measuring jig 41. The surface of the urethane foam layer 4*b* of the toner supplying roller 4 in general is different from the inside of the urethane foam layer 4*b* in many cases. For example, in the case where the toner supplying roller 4 is formed by in-mold foaming, a skin layer different in surface cell aperture ratio from the inside can appear at the surface. Further, the urethane foam layer 4*b* which has the surface which has not been formed simply as a cylindrical surface but has been intentionally provided with projections and recesses is also present. The toner powder fluid which enters and comes out of the inside of the urethane foam layer 4*b* can be influenced by the above-described surface state, so that behavior thereof cannot be grasped only by measurement of bulk air flow amount as defined in JIS-L 1096. Therefore, in this embodiment, the above-described air flow amount measuring method for measuring the air flow which enters and comes out of the surface of the urethane foam layer 4*b* as described above is employed and the measured air flow amount is used as a principal parameter for creating an equilibrium state of the toner powder fluid (or a state close thereto). Thus, by using the toner supplying roller 4 having a large surface air flow amount, interchange of the toner toward the inside and outside of the toner supplying roller 4 is smoothly effected and therefore a specific toner is prevented from remaining in the toner supplying roller 4, so that toner deterioration can be suppressed.

Figure 6:
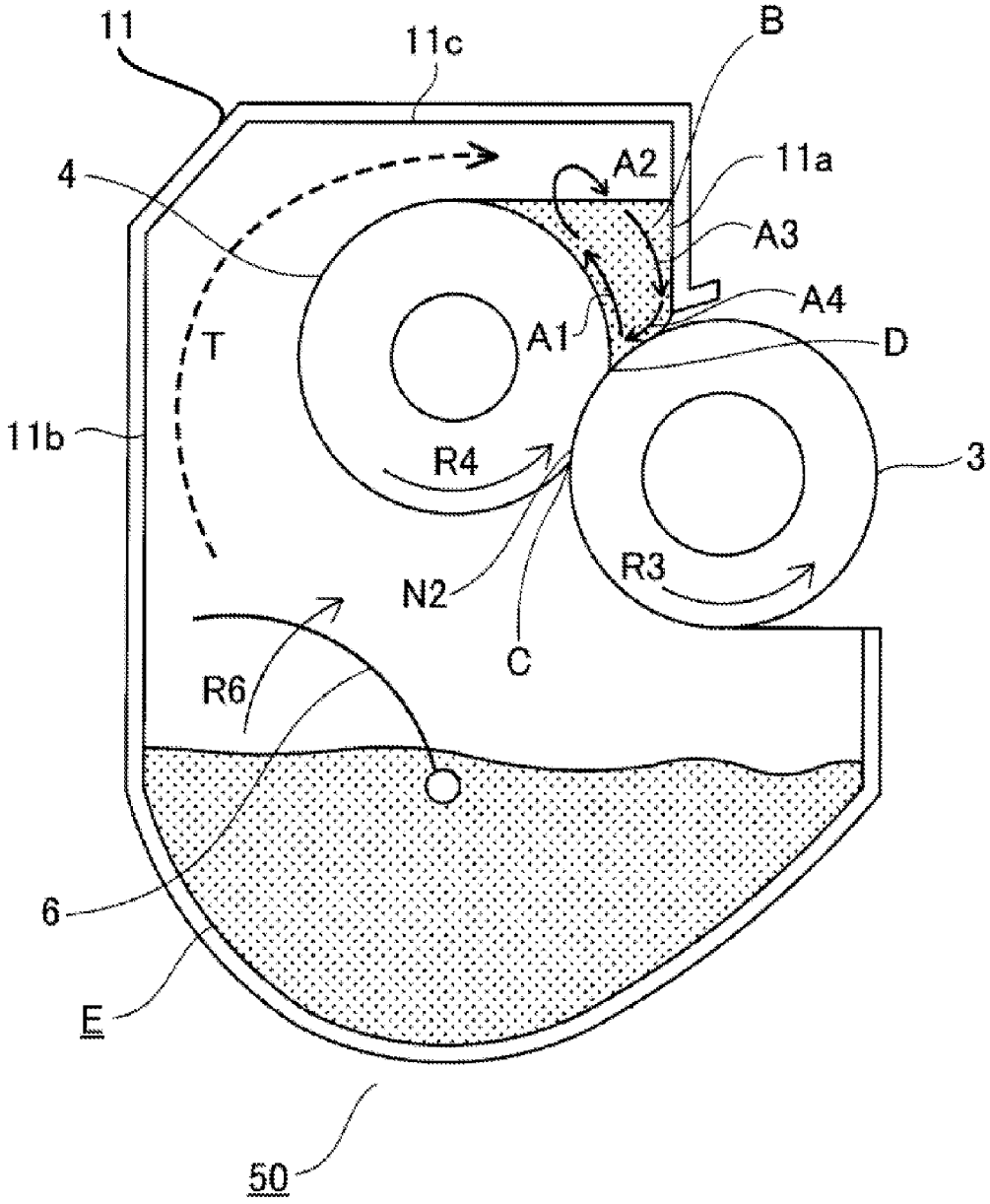
FIG. 6 is an enlarged schematic view of the neighborhood of a toner absorbing position of the toner supplying roller in Embodiment 1.

Next, with reference to FIG. 6, an operation of toner supply to the developing roller by the toner supplying roller in this embodiment will be described. FIG. 6 is an enlarged schematic view of the neighborhood of a toner absorbing position of the toner supplying roller 4. In the developing device 50 in this embodiment, when the toner supplying roller 4 rotates in contact to the developing roller 3, toner discharge occurs when the cell collapses at an outer peripheral portion of the toner supplying roller 4. Thereafter, the toner supplying roller 4 is opened, so that the cell opens. At that time, suction of the air toward the cell is effected, so that toner absorption occurs. That is, in the nip (contact portion) N2 between the toner supplying roller 4 and the developing roller 3, toner discharge occurs in the upstream side of the rotational direction of the toner supplying roller 4, and the toner absorption occurs in the downstream side. The upstream side is referred to as a toner discharging position C and the downstream side is referred to as a toner absorbing position.

In the neighborhood of the toner supplying roller 4, the toner is fed in an arrow A1 direction by powder pressure of the toner acting in the gravitation direction at a toner retaining portion B as a developer retaining portion and by the rotation of the toner supplying roller 4 itself. However, the toner fed by the rotation of the toner supplying roller 4 itself approaches a shallow portion of the toner retaining portion B with the rotation and is gradually prevented from being supplied with the powder pressure from the surrounding portion at the toner retaining portion B. Then, a force for urging the toner against the surface of the toner supplying roller 4 is no longer present, so that the toner is returned to the toner retaining portion B along an arrow A2 direction in the neighborhood of a topmost point of the toner supplying roller 4. Further, a flow of discharging air and toner is created at the toner retaining portion B when compression of the toner supplying roller 4 occurs at the toner discharging position C and then decompression occurs at the toner absorbing position D. Further, at the toner absorbing position D, the flow for absorbing the air and the toner is created. For that reason, the toner flows in the toner retaining portion B along directions of arrows A3 and A4, so that flow such that the toner is positively sent into the toner supplying roller 4 is created. By rotating the toner feeding member 6 provided in the toner accommodating chamber E in an arrow R6 direction opposite from the rotational direction R4 of the toner supplying roller 4, the toner passes through a feeding path T indicated by a broken line in FIG. 6 and is fed from the toner accommodating chamber E to above the toner retaining portion B. Then, the toner is first dropped in the neighborhood of the surface of the developing roller 3 and thereafter is sent to the toner absorbing position D by the rotation of the developing roller 3 and by the air flow. Then, at the toner absorbing position D, the toner is positively absorbed, so that efficient toner supply to the toner supplying roller 4 is realized. Incidentally, the feeding path T is such a path that the toner passes through a space between a rear inner wall 11*b* and the toner supplying roller 4 along the rear inner wall 11*b* opposite from the developing roller 3 in the case where the developing roller 3 side of the frame 11 is the front side, and further passes through a space between an upper inner wall 11*c* and the toner supplying roller 4 to reach the toner retaining portion B.

Figure 7:
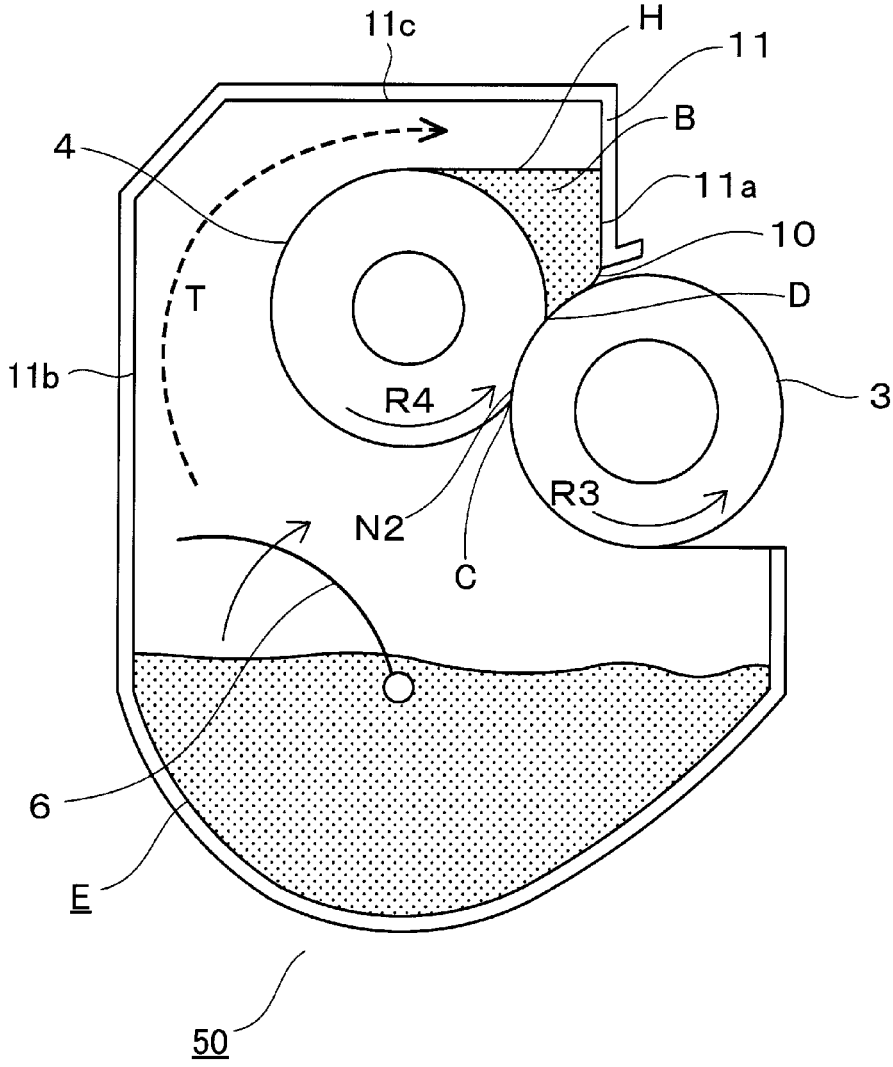
FIG. 7 is a sectional view for illustrating a toner retaining portion provided in a developing device according to Embodiment 1.

Next, with reference to FIG. 7, a constitution of the toner retaining portion B as a feature portion of this embodiment will be described. FIG. 7 is a sectional view for illustrating the toner retaining portion B provided in the developing device 50 in this embodiment. The toner retaining portion B is a region enclosed by the developing roller 3, the toner supplying roller 4, an upper front inner wall 11*a* of the frame 11 which is an inner wall of the frame 11 of the developing device 50 including a discharging-preventing sheet 10 and which is located in a side opposite from the feeding path T side and located above the developing roller 3, and a horizontal surface H connecting the topmost point of the toner supplying roller 4 and the upper front inner wall 11*a*. Incidentally, the discharging-preventing sheet 10 for preventing leakage of the toner from a gap between the developing roller 3 and the frame 11 is provided on the inner wall of the frame 11 but a member other than the sheet may also be provided if the member has an effect of preventing the toner leakage.

By feeding the toner in the toner accommodating chamber E (developer accommodating chamber) to the toner retaining portion B by the toner feeding member 6, the toner is retained at the toner retaining portion B. A state in which the toner is always present at the toner retaining portion B is formed by making the amount of the toner feedable to the toner retaining portion B by the toner feeding member 6 and a maximum amount of the toner retainable at the toner retaining portion B (volume of the toner retaining portion B) larger than the amount of the toner (developer) discharged by the toner supplying roller 4. Thus, the state in which the toner is always present at the toner retaining portion B is created, so that it becomes possible to suppress an image defect due to insufficient toner supply. In order to sufficiently obtain such an effect, the respective members constituting the toner retaining portion B may desirably be disposed so that a volume V of the toner retaining portion B satisfies the following formula:

$$V > \frac{Trs}{Ts} \times \{\pi r^2 - \pi(r - \Delta E)^2\} \times w \times R$$

where Trs represents the number of rotations per unit time (rpm) of said supplying roller, is represents the number of rotations per unit time (rpm) of said feeding member, ΔE represents a penetration depth (mm) of said supplying roller into said developing roller, r represents a radius (mm) of said supplying roller, R represents a porosity of said supplying roller, and w represents a longitudinal length of said supplying roller.

In the above formula, the right side represents a toner volume of the toner discharged by the toner supplying roller 4 at the toner discharging position C of the nip N2 during one full turn of the toner feeding member 6. When the above formula is satisfied, the toner at the toner retaining portion B scooped by the one full turn of the toner feeding member 6 can be supplied to the developing roller 3 with reliability during a period until the toner feeding member 6 subsequently scoops the toner.

In the developing device 50 in this embodiment, the topmost point of the toner supplying roller 4 was disposed 8 mm higher than the topmost point of the developing roller 3. In this case, the volume of the toner retaining portion B is 14080 $mm^3$. Further, in this embodiment, Trs=90 rpm, Ts=60 rpm, ΔE=1.5 mm, r=8 mm, R=0.6 and w=220 mm were set. When these parameters are substituted into the right side of the above formula, the volume of the toner discharged by the toner supplying roller 4 during the one full turn of the toner feeding member 6 is 13533 $mm^3$. The amount of the toner stored at the toner retaining portion B is larger than the amount of the toner discharged during the one full turn of the toner feeding member 6 and therefore the toner in a stable amount can be supplied to the developing roller 3. That is, it becomes possible to improve stability of a solid image density and supply a high-quality image.

Figure 8:
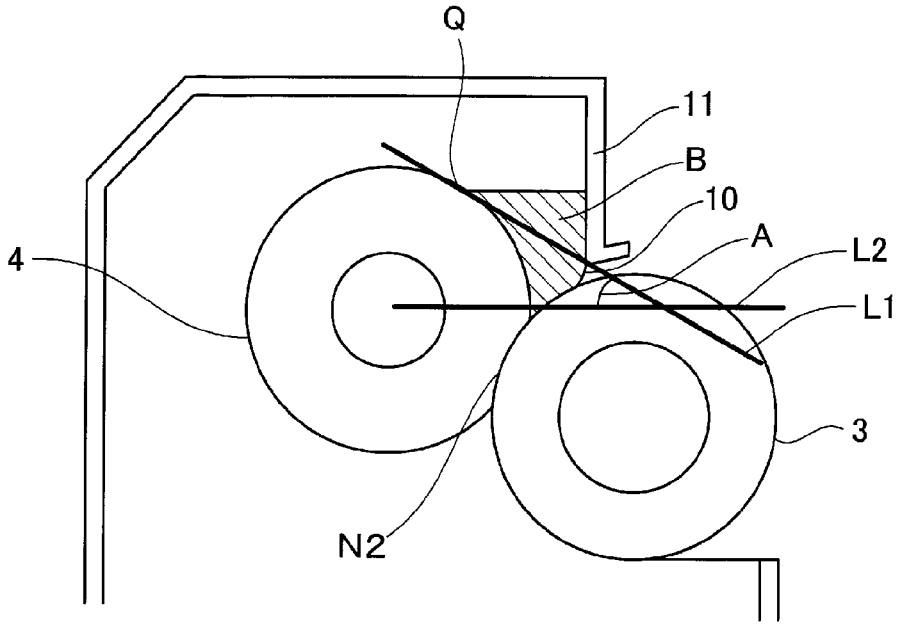
FIG. 8 is a schematic view for illustrating a relation between an angle of repose of a toner and the toner retainable at the toner retaining portion.

Further, the maximum amount of the toner retainable at the toner retaining portion B varies depending on an angle of repose of the toner. FIG. 8 is a schematic view for illustrating a relation between the angle of repose of the toner and the toner retainable at the toner retaining portion B. A point of contact between the topmost point of the retained toner and the toner supplying roller 4 in a state in which the toner is retained at the toner retaining portion B in an amount larger than the amount of the toner capable of being discharged by the toner supplying roller 4 in a time period of the one full turn in which the toner feeding member 6 feeds the toner to the toner retaining portion B is taken as a contact point Q. Further, a line of tangency of the toner supplying roller 4 at the contact point Q is taken as a tangent L1. As shown in FIG. 8, an angle formed between this tangent L1 and a horizontal line L2 is taken as an angle A. In the case where this angle A is larger than the angle of repose of the toner, the toner cannot climb a slope of the toner supplying roller 4. That is, the retained toner is moved by the toner supplying roller 4 and thus is not returned to the toner accommodating chamber E. In this state, the amount of the toner retainable at the toner retaining portion B is prevented from being less than the amount of the toner capable of being discharged by the toner supplying roller 4.

In the case where the developing device 50 is close to a brand-new state, the angle of repose of the toner is low, so that flowability of the toner is high. In this case, a toner retaining amount at the toner retaining portion B becomes large. Here, the state of the low angle of repose of the toner refers to a state in which an external additive such as silica is deposited on the toner surface in a large amount and thus the toner flowability becomes high or a state in which toner particles are not mutually agglomerated electrostatically in a high temperature and high humidity condition. In such a case where the angle of repose is low, the amount of the toner absorbed into the toner supplying roller 4 at the toner absorbing position D becomes large. Specifically, the angle of repose of the toner may preferably be 40 degrees or less. On the other hand, in the case where the angle of repose is high, the toner is in a state in which its flowability is low, so that the toner retaining amount at the toner retaining portion B becomes small. Here, the state of the high angle of repose refers to a state in which the external additive such as silica is embedded into the toner surface and thus the toner flowability becomes low or a state in which the toner particles are mutually agglomerated electrostatically. That is, in the case where the angle of repose of the toner is high, the amount of the toner absorbed into the toner supplying roller 4 at the toner absorbing position D becomes small.

In this embodiment, the angle of repose of the toner is 30 degrees. In the case where the angle A is larger than the angle of repose of the toner, the toner particles at the periphery of the toner supplying roller 4 cannot climb the slope (angle) of the toner supplying roller 4 by the rotation of the toner supplying roller 4 itself. On the other hand, in the case where the angle A is smaller than the angle of repose of the toner, the toner particles at the periphery of the toner supplying roller 4 are deposited on the surface of the toner supplying roller 4, so that the toner particles can climb the slope of the toner supplying roller 4 by the rotation of the toner supplying roller 4 itself. That is, the toner is returned again to the toner accommodating chamber E and is not retained at the toner retaining portion B. Further, the retainable toner varies, even when the angle of repose of the toner is the same, depending on a feeding power, a rotational speed of the toner supplying roller 4 depending on a surface roughness, a resistance or the like. However, when a relation such that the angle A is larger than the angle of repose of the toner is retained, it becomes possible to retain the toner at the toner retaining portion B even at any height (level) of the developer (toner) surface.

In the constitution in this embodiment, evaluation of solid image density followability was made. An evaluation condition was such that the image forming apparatus 100 was left for one day in an environment of 25° C. and 50% RH and was thus accustomed to the environment. Thereafter, a horizontal line image with an image ratio of 5% is printed on 100 sheets of A4-sized paper and then a solid black image is continuously outputted on 3 sheets. The image densities of the first sheet and the third sheet were compared. The image density was measured by using a measuring device ("Spectrodensitometer 500", mfd. by X-Rite Co.). As a result, a good result such that a difference, between the image densities of the first and third sheets, of less than 0.2 was obtained.

As described above, in the developing device in this embodiment, the topmost point of the toner supplying roller 4 was disposed at a higher position than the topmost point of the developing roller 3. By employing such a constitution, the volume of the toner retaining portion B can be sufficiently ensured. That is, the amount of the toner accumulated at the toner retaining portion B becomes larger than the amount of the toner discharged during the one full turn of the toner feeding member 6, so that the toner in a stable amount can be supplied to the developing roller 3. Further, the amount of the toner fed to the toner retaining portion B by the toner feeding member 6 becomes larger than the amount of the toner discharged by the toner supplying roller 4, so that the state in which the toner is always present at the toner retaining portion B is created. Therefore, in Embodiment 1, it is possible to suppress the image defect due to the insufficient toner feeding to the toner retaining portion B.

Embodiment 2

Figure 9:
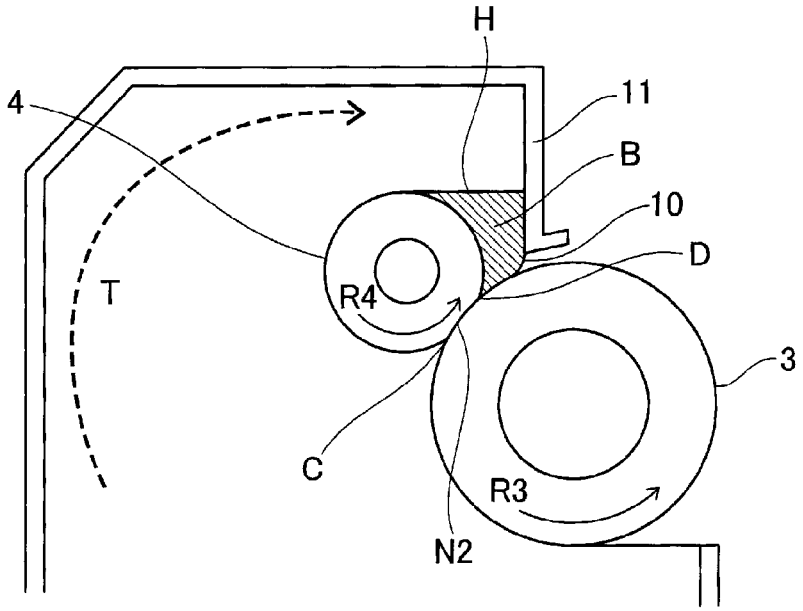
FIG. 9 is an enlarged schematic view of the neighborhood of a toner absorbing position of a toner supplying roller in Embodiment 2.

Next, with reference to FIG. 9, a developing device in this embodiment will be described. FIG. 9 is a schematic view of the neighborhood of a toner absorbing position D of a toner supplying roller 4 in Embodiment 2. In this embodiment, in order to ensure a volume of a toner retaining portion B, a topmost point of the toner supplying roller 4 was disposed at a higher position than a topmost point of a developing roller 3 and in order to reduce a cost of the toner supplying roller 4, the size of the toner supplying roller 4 was made smaller than that of the toner supplying roller 4 used in Embodiment 1. Other members are the same as those used in Embodiment 1 unless otherwise specified. In this embodiment, the toner supplying roller 4 is downsized but the topmost point of the toner supplying roller 4 is located at the higher position than the topmost point of the developing roller 3 and therefore a large-volume toner retaining portion B can be formed between the toner supplying roller 4 and a frame inner wall 11. Further, by decreasing a diameter of the toner supplying roller 4, when the toner is fed from the toner accommodating chamber E to the toner retaining portion B by the toner feeding member 6, a feeding path T can be broadened.

As described above, in the developing device in this embodiment, the topmost point of the toner supplying roller 4 was disposed at a higher position than the topmost point of the developing roller 3. By employing such a constitution, the volume of the toner retaining portion B can be sufficiently ensured. That is, the amount of the toner accumulated at the toner retaining portion B becomes larger than the amount of the toner discharged during the one full turn of the toner feeding member 6, so that the toner in a stable amount can be supplied to the developing roller 3. Further, the amount of the toner fed to the toner retaining portion B by the toner feeding member 6 becomes larger than the amount of the toner discharged by the toner supplying roller 4, so that the state in which the toner is always present at the toner retaining portion B is created. Further, by downsizing the toner supplying roller 4, the volume of the toner retaining portion B can be increased, so that the amount of the toner retainable at the toner retaining portion B was increased. Further, by decreasing a diameter of the toner supplying roller 4, when the toner is fed from the toner accommodating chamber E to the toner retaining portion B by the toner feeding member 6, a feeding path T can be broadened. As a result, the toner can be easily fed upward, so that a feeding efficiency was improved. As a result, a frequency of operation of the toner feeding member 6 can be reduced, so that it was also possible to obtain effects of reducing electric power consumption, reducing a torque and suppressing noise resulting from driving noise.

Comparative Embodiment 1

Next, Comparative Embodiment 1 will be described with reference to (a) of FIG. 10. Part (a) of FIG. 10 is a sectional view of the neighborhood of a toner absorbing position D of a toner supplying roller 4 in Comparative Embodiment 1. In a developing device in Comparative Embodiment 1, a topmost point of the toner supplying roller 4 is disposed at a position lower than a topmost point of a developing roller 3. In this case, a toner retaining portion B is a region enclosed by the developing roller 3, the toner supplying roller 4 and a horizontal line I connecting the topmost point of the toner supplying roller 4 and the developing roller 3. In this case, the volume of the toner retaining portion B cannot be larger than the volume of the toner retaining portion B in the case where the topmost point of the toner supplying roller 4 is disposed at a position higher than the topmost point of the developing roller 3. Further, in the case of such an arrangement, a toner deposited on the surface of the toner supplying roller 4 and conveyed by rotation of the toner supplying roller 4 climbs a slope of the toner supplying roller surface to generate a flow of the toner returned to a toner accommodating chamber E, so that the toner is insufficient at a toner absorbing position D. For that reason, effective toner absorption is hindered, so that the image defect due to the insufficient toner supply is caused.

Comparative Embodiment 2

Part (b) of FIG. 10 is a sectional view of the neighborhood of a toner absorbing position D of a toner supplying roller 4 in Comparative Embodiment 2. A Ina developing device in Comparative Embodiment 2, with respect to the same arrangement of the toner supplying roller 4 and the developing roller 3 as in Comparative Embodiment 1 above, the diameters of the toner supplying roller 4 and the developing roller 3 have been increased in order to realize a large volume of toner transfer away from toner retaining portion B. In this case, upsizing and high cost of the developing device with the increase in diameter of the toner supplying roller 4 are problematic. Further, by the increase in diameter of the toner supplying roller 4, a feeding path is narrowed and it becomes difficult to feed the toner upward and therefore an efficiency of toner retaining portion is lowered. For that reason, the image defect due to the insufficient toner supply is caused. Further, the toner feeding path T is narrowed and thus an efficiency of toner feeding becomes poor and therefore a frequency of an operation of a toner feeding member 6 is increased, so that there also arose problems of an increase in electric power consumption and noise resulting from driving noise.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 158941/2011 filed Jul. 20, 2011, which is hereby incorporated by reference.

What is claimed is:

1. A developing device for use with an image forming apparatus, comprising:

a developing roller for carrying a developer and for forming a developer image on an image bearing member;

a supplying roller for supplying the developer to said developing roller, wherein said supplying roller has a foam layer at its surface and forms a nip between itself and said developing roller;

an accommodating portion, provided below said supplying roller, for accommodating the developer; and a feeding member for feeding the developer from said accommodating portion to a location above the nip by being rotated in a direction opposite to a rotational direction of said supplying roller, wherein said supplying roller is rotated in a direction which is from a lower end of the nip to an upper end of the nip, and wherein said supplying roller is provided so that its top is higher than a top of said developing roller.

2. A device according to claim 1, wherein an angle of repose of the developer is 40 degrees or less.

3. A device according to claim 1, wherein during one rotation of said feeding member, a maximum amount of the developer retainable in the location above the nip is larger than an amount of the developer discharged downward from the nip by said supplying roller.

4. A device according to claim 1, wherein an amount V ($mm^3$) of the developer retainable in the location above the nip satisfies the following formula:

$$V > \frac{Trs}{Ts} \times \{\pi r^2 - \pi(r - \Delta E)^2\} \times w \times R$$

where Trs represents the number of rotations per unit time (rpm) of said supplying roller, Ts represents the number of rotations per unit time (rpm) of said feeding member, ΔE represents a penetration depth (mm) of said supplying roller into said developing roller, r represents a radius (mm) of said supplying roller, R represents a porosity of said supplying roller, and w represents a longitudinal length of said supplying roller.

5. A device according to claim 1, wherein during one rotation of said feeding member, an amount of the developer fed to the location above the nip by said feeding member is larger than an amount of the developer discharged downward from the nip by said supplying roller.

6. A process cartridge detachably mountable to a main assembly of an image forming apparatus, said process cartridge comprising:

an image bearing member for forming a developer image; and a developing device including: a developing roller for carrying a developer and for forming the developer image on said image bearing member; a supplying roller for supplying the developer to said developing roller, wherein said supplying roller has a foam layer at its surface and forms a nip between itself and said developing roller; an accommodating portion, provided below said supplying roller, for accommodating the developer; and a feeding member for feeding the developer from said accommodating portion onto the nip by being rotated in a direction opposite to a rotational direction of said supplying roller, wherein said supplying roller is rotated in a direction which is from a lower end of the nip to an upper end of the nip, and wherein said supplying roller is provided so that its top is higher than a top of said developing roller.

7. A cartridge according to claim 6, wherein an angle of repose of the developer is 40 degrees or less.

8. A cartridge according to claim 6, wherein during one rotation of said feeding member, a maximum amount of the developer retainable on the nip is larger than an amount of the developer discharged downward from the nip by said supplying roller.

9. A cartridge according to claim 6, wherein an amount V ($mm^3$) of the developer retainable on the nip satisfies the following formula:

$$V > \frac{Trs}{Ts} \times \{\pi r^2 - \pi(r - \Delta E)^2\} \times w \times R$$

where Trs represents the number of rotations per unit time (rpm) of said supplying roller, Ts represents the number of rotations per unit time (rpm) of said feeding member, ΔE represents a penetration depth (mm) of said supplying roller into said developing roller, r represents a radius (mm) of said supplying roller, R represents a porosity of said supplying roller, and w represents a longitudinal length of said supplying roller.

10. A cartridge according to claim 6, wherein during one rotation of said feeding member, an amount of the developer fed onto the nip by said feeding member is larger than an amount of the developer discharged downward from the nip by said supplying roller.

11. A cartridge according to claim 6, wherein said feeding member feeds the developer to a location above the nip.

12. An image forming apparatus for forming an image on a recording material, comprising:

an image bearing member for forming a developer image; and a developing device including: a developing roller for carrying a developer and for forming the developer image on said image bearing member; a supplying roller for supplying the developer to said developing roller, wherein said supplying roller has a foam layer at its surface and forms a nip between itself and said developing roller; an accommodating portion, provided below said supplying roller, for accommodating the developer; and a feeding member for feeding the developer from said accommodating portion to a location above the nip by being rotated in a direction opposite to a rotational direction of said supplying roller; and a transferring device for transferring the developer image onto the recording material, wherein said supplying roller is rotated in a direction which is from a lower end of the nip to an upper end of the nip, and wherein said supplying roller is provided so that its top is higher than a top of said developing roller.

13. An apparatus according to claim 12, wherein an angle of repose of the developer is 40 degrees or less.

14. An apparatus according to claim 12, wherein during one rotation of said feeding member, a maximum amount of the developer retainable in the location above the nip is larger than an amount of the developer discharged downward from the nip by said supplying roller.

15. An apparatus according to claim 12, wherein an amount V ($mm^3$) of the developer retainable in the location above the nip satisfies the following formula:

$$V > \frac{Trs}{Ts} \times \{\pi r^2 - \pi(r - \Delta E)^2\} \times w \times R$$

where Trs represents the number of rotations per unit time (rpm) of said supplying roller, Ts represents the number of rotations per unit time (rpm) of said feeding member, ΔE represents a penetration depth (mm) of said supplying roller into said developing roller, r represents a radius (mm) of said supplying roller, R represents a porosity of said supplying roller, and w represents a longitudinal length of said supplying roller.

16. An apparatus according to claim 12, wherein during one rotation of said feeding member, an amount of the developer fed to the location above the nip by said feeding member is larger than an amount of the developer discharged downward from the nip by said supplying roller.

* * * * *